United States Patent [19]

Miller

[11] 4,138,806

[45] Feb. 13, 1979

[54] ANCHORING DEVICE FOR VEHICLES AND OTHER STRUCTURES

[75] Inventor: Milton J. Miller, Goshen, Ind.

[73] Assignees: MHA Corporation, Goshen, Ind.; Aluminum Plumbing Fixture Corp., Burlingame, Calif.

[21] Appl. No.: 859,840

[22] Filed: Dec. 12, 1977

[51] Int. Cl.[2] ..... E04H 12/20

[52] U.S. Cl. ..... 52/149; 52/157; 52/DIG. 11

[58] Field of Search ..... 52/DIG. 11, 23, 148, 52/149, 150, 157; 24/269, 68 BT, 68 CD, 71.1; 254/161

[56] References Cited

U.S. PATENT DOCUMENTS

| | | | |
|---|---|---|---|
| 881,651 | 3/1908 | Barbrake | 254/161 X |
| 3,856,265 | 12/1974 | Foster | 52/DIG. 11 X |
| 3,884,450 | 5/1975 | Brammer | 52/DIG. 11 X |
| 4,003,169 | 1/1977 | Young | 24/269 X |

*Primary Examiner*—Price C. Faw, Jr.
*Assistant Examiner*—Carl D. Friedman
*Attorney, Agent, or Firm*—Marmaduke A. Hobbs; Robert G. Slick

[57] ABSTRACT

An anchor device adapted for securing mobile, modular and motor homes, trailers, campers and similar units, having an anchor for insertion into the ground on opposite sides of the unit, and a strap, cable or other flexible member extending over the unit from one anchor to the other. The device is mounted on the anchor and has U-shaped body and a reel shaft on which the end of the flexible member is wound. One end of the reel shaft has a transverse hole and the body has a lug with a hole adjacent the transverse hole in the reel shaft. After an adjustment has been made, a pin is inserted through the holes in the lug and reel shaft to hold the flexible member in a secured position. A slot means is provided on the other end of the reel shaft for receiving a tool for operating the shaft to tighten the flexible member. The device may have two reel shafts of similar construction and in parallel arrangement for attaching a first flexible member extending over the unit and a second flexible member secured to a structural element on the lower portion of the unit.

10 Claims, 8 Drawing Figures

ANCHORING DEVICE FOR VEHICLES AND OTHER STRUCTURES

Mobile homes, motor homes, trailers, campers and similar vehicles are usually not placed on a substantial foundation but are left on their undercarriages, and sometimes placed on concrete blocks or stabilizing jacks. Further, modular and double wide homes, while often placed on permanent foundations, are constructed of relatively light and frail materials so that they can be produced in a manufacturing plant and transported in sections to the permanent location. Since these types of vehicles and structures are light in weight for their size, they are particularly vulnerable to high winds often accompanying violent storms such as tornadoes, hurricanes, blizzards and thunderstorms, and are relatively easily overturned and moved from their site and are crushed or otherwise seriously damaged or destroyed. In order to minimize this type of hazard, guy wires with turn buckles and various types of strap systems have been used in the past to anchor the units and prevent them from being blown from their locations. The prior systems have often been unsatisfactory in that they are difficult and time consuming to install and to tighten sufficiently to be dependable under most of the foregoing adverse conditions, and they occasionally become loose and unreliable. Attempts have been made to overcome the disadvantages of the conventional guy wires, cables, straps and the like anchored to the ground on opposite sides of the vehicle; however, the means used to overcome these have had certain drawbacks, including difficulty in installing and tightening the cables and straps to prevent them from becoming loosened by the force of the wind. Further, the tightening or adjustment devices for securing the wires or straps to an anchor placed in the ground are difficult to operate and tighten under various installation conditions, such that they may be ineffectively adjusted or soon become loose after an installation has been completed. It is therefore one of the principal objects of the present invention to provide an anchoring device for straps or cables for securing mobile, modular and motor homes, trailers, campers and similar vehicles and structures, which can be effectively installed in limited areas and which will firmly and reliably connect the ends of the straps to the anchor structure, and which may be readily, effectively installed in conjunction with various types of supports for the vehicles and structures without requiring any changes in the device.

Another object of the invention is to provide a device for connecting a cable or metal strap to an anchor structure, which is simple in construction and operation, and which can be used to retain a single strap or cable placed over the vehicle or structure or to a frame member beneath the vehicle or structure or connect both types of straps or cables at the same time to the anchor structure.

Still another object of the invention is to provide an anchoring device for the aforementioned types of vehicles and structures, which can be easily installed and readily adjusted to maximum effectiveness when the installation is made, and thereafter quickly adjusted in anticipation of or during a storm if the anchor structure should become loosened, and which can readily be installed to give the required protection for overnight use, while the vehicles or structures are in transit, and thereafter quickly released when the vehicle or structure is to be moved.

A further object of the invention is to provide an anchor device for mobile and modular homes, trailers, motor homes and units, which is inconspicuous when installed and trouble free for long periods of time in permanent installations, and which can effectively be adapted to various types and makes of units and structures without changing the structure of the device.

Additional objects and advantages of the present anchoring device will become apparent from the following description and accompanying drawings, wherein.

Figure 1:
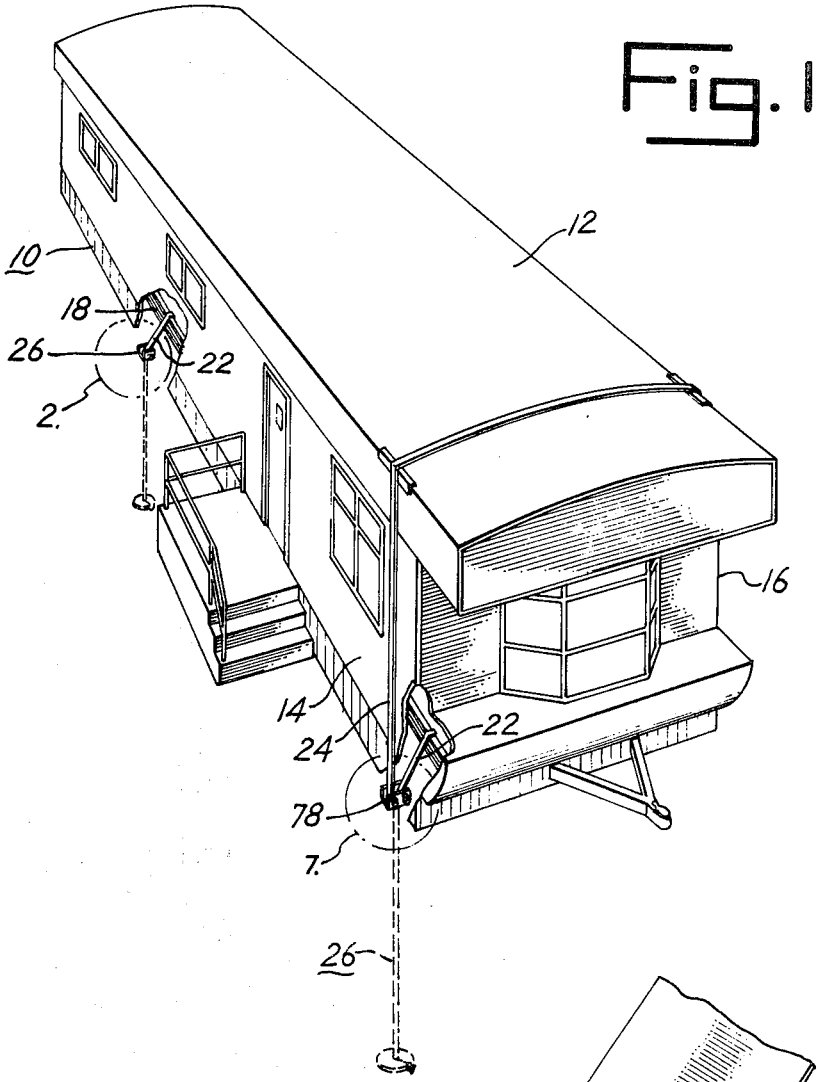
FIG. 1 is a perspective view of a mobile home, illustrating the use of the present anchor device therein.

Referring more specifically to the drawings, and to FIG. 1 in particular, numeral 10 indicates generally a mobile home having a roof 12, side walls 14 and 16, and a frame 18, one side member of the frame being shown in the broken away portions of FIG. 1. When the mobile home is placed in a permanent or semipermanent location, it is usually placed on blocks or jacks which remove some or all of the pressure on the wheels of the undercarriage attached to frame 18. The blocks or jacks stabilize the home structure and support the home near the two ends, and either with or without the wheels, form the main support of the home structure. The mobile home shown is merely for the purpose of illustrating the present anchor device and system, which may be used with a variety of different types of vehicles and building structures.

Figure 2:
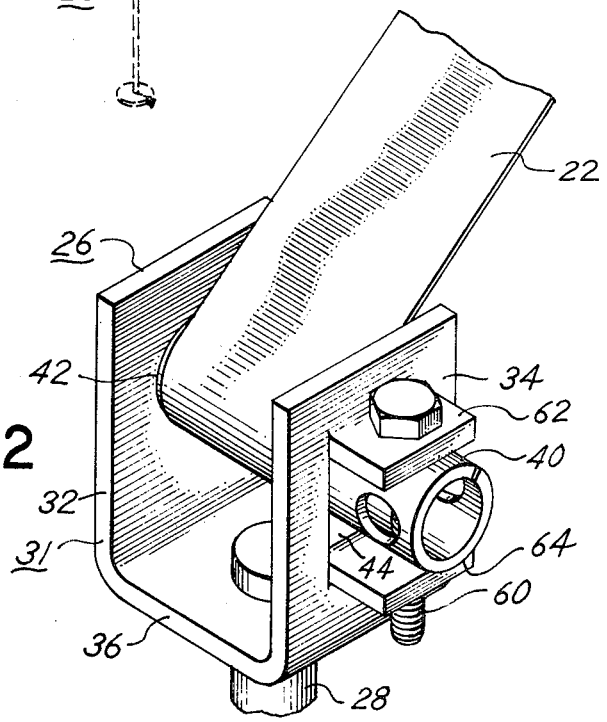
FIG. 2 is an enlarged perspective view of the present anchor device, showing it connected to a strap for anchoring a mobile home or other structure.
Figure 3:
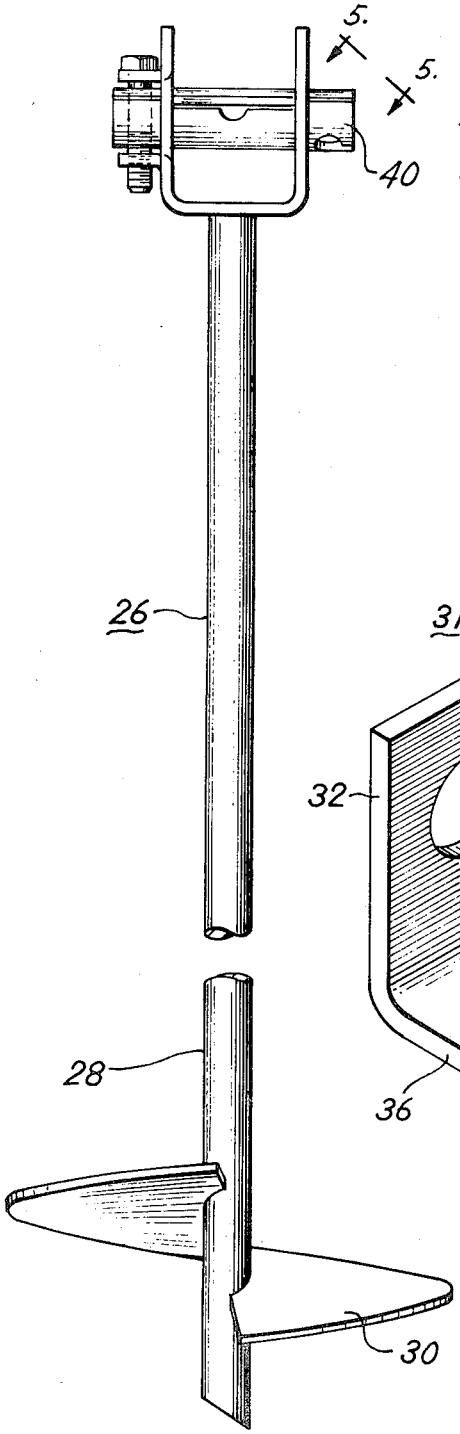
FIG. 3 is an elevational view of an anchor with the present anchor device.
Figure 4:
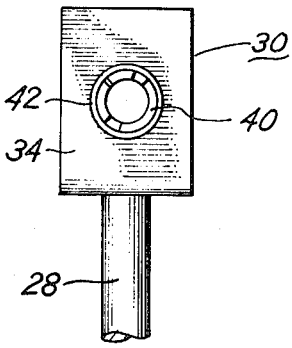
FIG. 4 is a side elevational view of the anchor device shown in the preceding figures.
Figure 5:
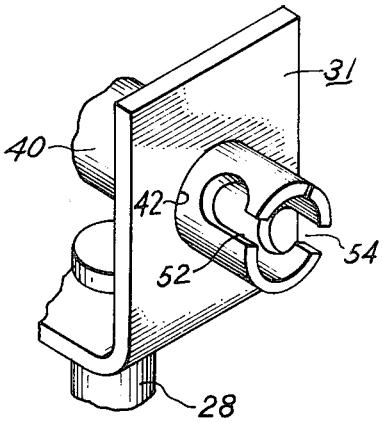
FIG. 5 is a fragmentary perspective view of the present anchor device, the view being from the position illustrated by lines 5 — 5 of FIG. 3.
Figure 5:
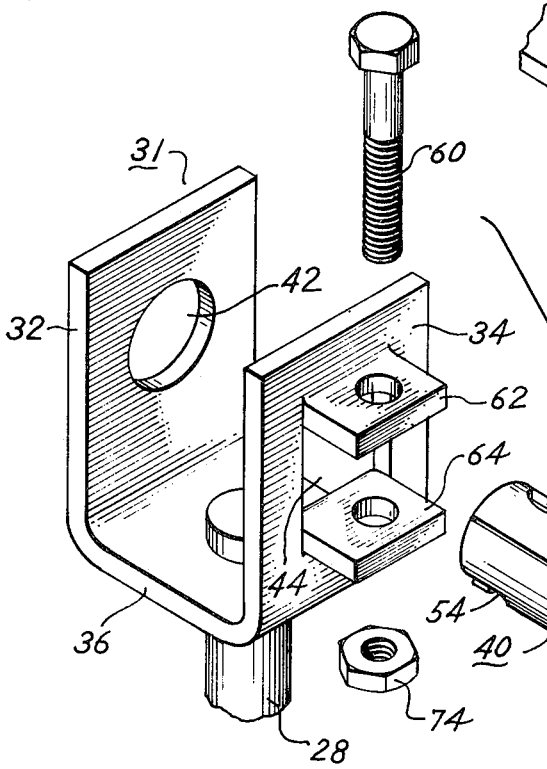
Figure 6:
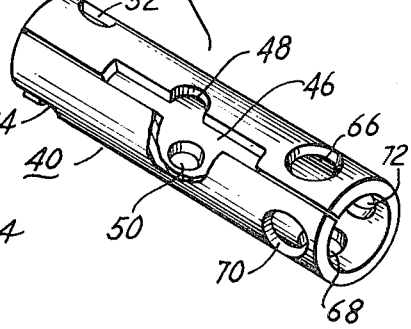
FIG. 6 is an exploded perspective view of the present anchor device shown in the preceding figures.
Figure 7:
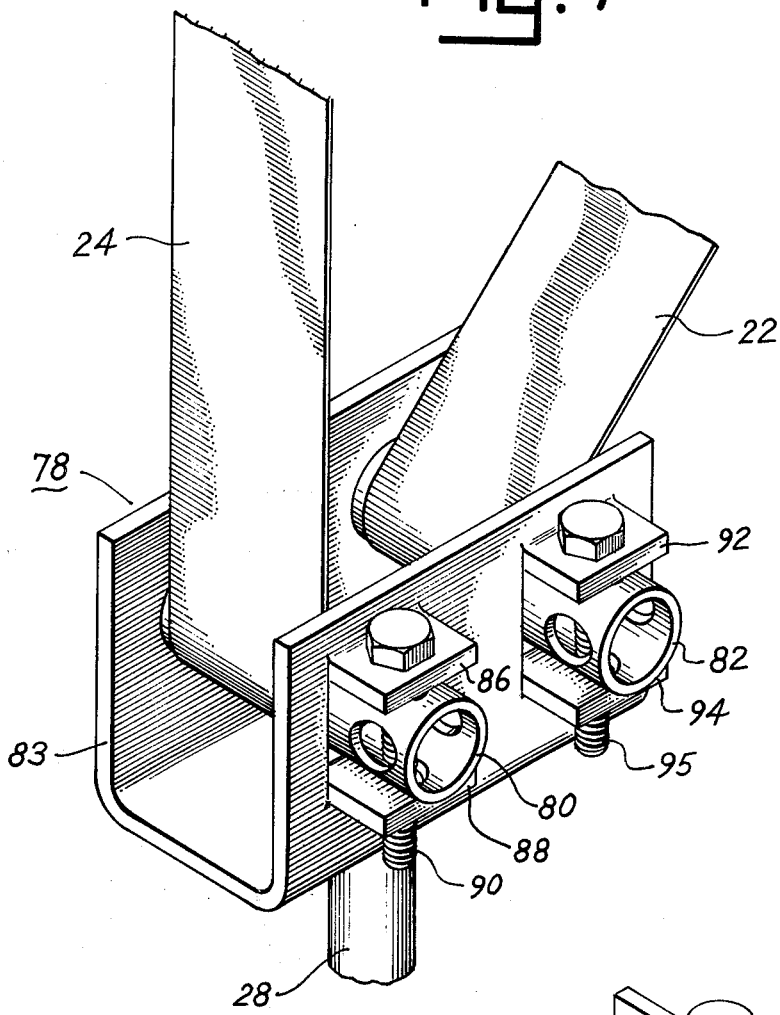
FIG. 7 is a perspective view of a modified form of an anchor device embodying the present invention.

The present invention is directed primarily to the anchor devices illustrated in FIGS. 2 and 7 for connecting a strip metal band or strap 22 and/or 24 to an anchor 26, shown on the drawings as consisting of a shaft 28 and an auger 30 for screwing the anchor into the ground. Normally a pair of anchors 26 are placed in the ground near the forward end of the mobile home and another pair near the rear end of the home, and straps 22 and 24, or cables or other elongated flexible members, are used to secure the mobile home or other structure to the anchor.

The anchor device 26 consists of a U-shaped body 31 having upwardly extending arms 32 and 34 connected by a horizontal member 36 to form a U-shaped structure, member 36 being rigidly attached to the upper end of shaft 28 of the anchor. A reel shaft 40 is disposed in oppositely positioned holes 42 and 44 in arms 32 and 34, respectively, and includes a slot 46 for receiving the end of either strap 22 or 24. Since the device can be used effectively with a cable, a slot 48 and an opposed hole 50 are adapted to receive the end of the cable, thus permitting either a strap or cable to be wound on the reel shaft.

The reel shaft 40 is rotated to wind strap 22 or 24 or other elongated flexible member on the shaft by the insertion of a tool head in slots 52 and 54 in one end of the shaft. A ratchet type wrench is preferable, since it permits the operation of the wrench in a limited space in small strokes without fully rotating the wrench. After an adjustment has been made by rotating the reel shaft, the shaft is held in its adjusted position by a screw 60 or other type of pin extending downwardly through holes in lugs 62 and 64 attached to the side of U-shaped member 31, and through opposed holes 66 and 68 or 70 and 72 in the shaft. The lugs are preferably formed integrally with the side by stamping them from the side and turning them laterally to a horizontal position. This stamping and turning operation simultaneously forms hole 44. After the screw has been inserted through the respective holes in the lug and reel shaft, a nut 74 is preferably threaded onto the end thereof to hold the screw firmly in place and the reel shaft in its adjusted position.

In the operation of the embodiment of the invention illustrated in FIGS. 1 through 6, using auger 30, anchor 26 is inserted in the ground on opposite sides of the mobile home or other structure, and either strap 22 or 24 or cable or other elongated flexible member, which has been placed over the mobile home or attached to the frame, is connected to the reel shaft 40 by placing the end in slot 46, or if there is a cable, through slot 48 and hole 50. A tool head is then placed in slots 52 and 54 and reel shaft 40 is rotated to wind the flexible member. The strap, for example, is wound on the reel until the mobile home or other structure is firmly secured, and screw 60 is then inserted into the holes in the lugs and the corresponding end of the shaft reel, and nut 74 is threaded onto the screw, thus locking the reel shaft firmly in its adjusted position. In the event an adjustment is required at any time after the installation, the operation can easily be performed by removing the screw from the holes in the shaft and lugs and again rotating the reel shaft with a wrench and then reinserting the screw through the holes to lock the reel shaft in its readjusted position. This operation can be performed quickly in anticipation of a wind storm or other adverse weather conditions.

Figure 8:
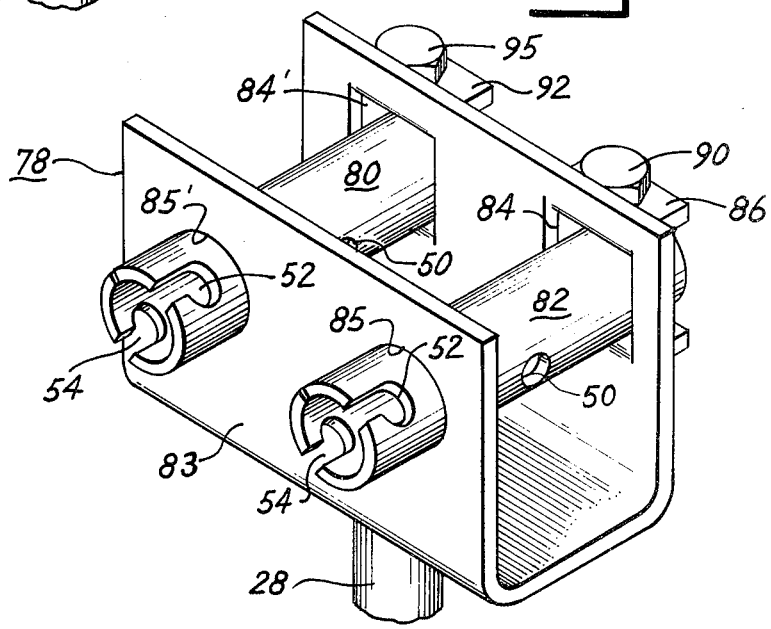
FIG. 8 is a perspective view from the side opposite the side seen in FIG. 7.

The embodiment of the invention illustrated in FIGS. 7 and 8 is essentially the same as that previously described herein, except that the anchor device 78 is enlarged to include two reel shafts 80 and 82 journaled in a U-shaped body 83 in holes 84 and 85 and 84' and 85', respectively. The two reel shafts are identical in construction and operation to reel shaft 40 and to each other, and hence like numerals will be used to refer to like parts. In this modified form, lugs 86 and 88 retain a screw 90 and lugs 92 and 94 retain a screw 95 and these two screws are held in place by nuts in the same manner as screw 60. The double reel shaft structure of FIGS. 7 and 8 permits the anchor to secure the mobile home or other structure with both straps 22 and 24, with strap 22 being attached to the frame and strap 24 extending over the structure. Thus, one anchor device provides double protection to the structure. The U-shaped body 83, which is constructed of metal, is secured to shaft 28 by welding or other suitable securing means, and forms a firm adjustable reel structure for the straps. The anchor device of FIGS. 7 and 8 is installed and operated in essentially the same manner as the one illustrated in FIG. 2, with the exception that two straps, cables or other flexible members can be used simultaneously in the modified form.

It is seen that the present anchor device can be easily installed, and the straps, cables, or other elongated flexible member can be readily attached and adjusted to a firm, securing position to retain the structure in an effective anchored condition. The device is simple in construction and reliable in operation, and can be used in a variety of different applications including, but not limited to, those mentioned herein. Various changes and modifications may be made in the anchor device of either embodiment without departing from the scope of the invention.

I claim:

1. For use in an anchor system adapted for mobile, modular and motor homes, trailers, campers and similar units, and having an anchor for attachment to the ground, and an elongated flexible member extending upwardly from said anchor and engaging the structure of said units: an anchor device for tensioning and adjusting said flexible member, comprising a generally U-shaped body attached to said anchor and having aligned holes in the arms thereof, a reel shaft of tubular shape journaled in said aligned holes, means for attaching one end of said elongated member to said reel shaft for winding thereon, means defining a transverse hole near one end of said reel shaft, a lug disposed on the external side of said U-shaped member adjacent said transverse hole and having a hole therein for alignment with said transverse hole, a pin-like member extending through the holes in said lug and reel shaft, and slot-like means extending inwardly from the other end of said reel shaft and having an open end and a laterally off-set portion for releasably retaining an operating tool in engagement with said reel shaft.

2. An anchor device as defined in claim 1 in which said elongated member consists of a strap extending over the frame structure of the unit, and said reel shaft includes a means for attaching one end of said strap thereto.

3. An anchor device as defined in claim 2 in which said means for attaching one end of said strap to said reel shaft consists of a longitudinally extending slot in said shaft.

4. An anchor device as defined in claim 1 in which said anchor consists of a shaft and an auger secured to one end of said shaft, and said device is secured to the other end of said shaft with the bottom of said U-shaped member secured to the shaft.

5. An anchor device as defined in claim 1 in which said lug is stamped from and formed integrally with the side wall of said U-shaped body.

6. An anchor device as defined in claim 1 in which said body has a second set of aligned holes in spaced relation to said other shaft, a second shaft with a transverse hole near one end mounted in said second set of holes, and a lug disposed on the external side of said body disposed adjacent the transverse hole in said second mentioned shaft and having a hole therein for alignment with the hole in the respective reel shaft, said second shaft having a means for attaching a flexible member thereto.

7. An anchor device as defined in claim 6 in which said flexible member consists of a strap for connection with a structural member of the unit, and said second reel shaft includes a means at the other end for receiving an operating tool.

8. An anchor device as defined in claim 7 in which said means for attaching one end of said strap to said reel shaft consists of a longitudinally extending slot in said shaft.

9. An anchor device as defined in claim 6 in which said anchor consists of a shaft and an auger secured to one end of said shaft, and said device is secured to the other end of said shaft with the bottom of said U-shaped member secured to the upper end of the anchor shaft.

10. An anchor device as defined in claim 6 in which said second shaft has a slot-like means extending inwardly from the other end and having an open end and a laterally off-set portion for releasably retaining an operating tool in engagement with said shaft.

* * * * *

UNITED STATES PATENT AND TRADEMARK OFFICE

CERTIFICATE OF CORRECTION

PATENT NO. : 4,138,806

DATED : February 13, 1979

INVENTOR(S) : Milton J. Miller

It is certified that error appears in the above-identified patent and that said Letters Patent are hereby corrected as shown below:

On the Title page, Item [73] should read as follows:

-- MHA Corporation, Goshen, Ind. --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*